US011081052B2

(12) United States Patent
Yang et al.

(10) Patent No.: US 11,081,052 B2
(45) Date of Patent: Aug. 3, 2021

(54) METHOD AND APPARATUS FOR DETECTING THRESHOLD VOLTAGE OF DRIVING TRANSISTOR, AND DISPLAY APPARATUS

(71) Applicants: HEFEI XINSHENG OPTOELECTRONICS TECHNOLOGY CO., LTD., Hefei (CN); BOE TECHNOLOGY GROUP CO., LTD., Beijing (CN)

(72) Inventors: Fei Yang, Beijing (CN); Xiaolong Wei, Beijing (CN); Wenchao Bao, Beijing (CN); Min He, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/931,926

(22) Filed: May 14, 2020

(65) Prior Publication Data

US 2020/0273405 A1 Aug. 27, 2020

Related U.S. Application Data

(63) Continuation-in-part of application No. PCT/CN2019/090591, filed on Jun. 10, 2019.

(30) Foreign Application Priority Data

Jun. 12, 2018 (CN) ..... 201810605178.7

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01)

(58) Field of Classification Search
CPC .. G09G 3/3258; G09G 3/3233; G09G 3/3291; G09G 2320/0233; G09G 2320/043; G09G 2300/0819; G09G 2300/043
(Continued)

(56) References Cited

U.S. PATENT DOCUMENTS 7,667,524 B2 * 2/2010 Thierry ..... H03K 19/00323 327/374
9,214,107 B2 * 12/2015 Fish ..... G09G 3/3233
(Continued)

FOREIGN PATENT DOCUMENTS

CN 104835469 A 8/2015
CN 105788530 A 7/2016
(Continued)

OTHER PUBLICATIONS

International Search Report and Writen Opinion issued in International Patent Application No. PCT/CN2019/090591, dated Aug. 27, 2019; with English translation.
(Continued)

*Primary Examiner* — Tom V Sheng
(74) *Attorney, Agent, or Firm* — McDermott Will and Emery LLP

(57) ABSTRACT

A method for detecting a threshold voltage of a driving transistor includes: obtaining at least one first threshold voltage of at least one driving transistor when each driving transistor is driven by a corresponding first driving signal; obtaining a threshold reference voltage of the driving transistor according to the at least one first threshold voltage; obtaining a second driving signal of the driving transistor according to the threshold reference voltage and the first
(Continued)

driving signal of the driving transistor, a value of the second driving signal being greater than a value of the first driving signal; and obtaining a second threshold voltage of the driving transistor when the driving transistor is driven by the second driving signal.

20 Claims, 4 Drawing Sheets

(58) Field of Classification Search
USPC ..... 345/214
See application file for complete search history.

(56) References Cited

U.S. PATENT DOCUMENTS

| | | | | |
|---|---|---|---|---|
| 9,460,661 | B2 * | 10/2016 | Shim | G09G 3/3233 |
| 9,830,854 | B2 * | 11/2017 | Kim | G09G 3/3233 |
| 10,338,730 | B2 * | 7/2019 | Kim | G06F 3/0416 |
| 10,366,676 | B2 * | 7/2019 | Kim | G09G 3/3233 |
| 2011/0316892 | A1 * | 12/2011 | Sung | G09G 3/3233 345/690 |
| 2015/0364092 | A1 * | 12/2015 | Kim | G09G 3/3233 345/205 |
| 2016/0246409 | A1 * | 8/2016 | Yang | G09G 3/3233 |
| 2016/0247450 | A1 | 8/2016 | Liu et al. | |
| 2016/0253953 | A1 * | 9/2016 | Yang | G09G 3/2074 345/214 |
| 2017/0372655 | A1 | 12/2017 | Wang et al. | |
| 2018/0240410 | A1 | 8/2018 | Yang et al. | |
| 2019/0066578 | A1 * | 2/2019 | Chen | G09G 3/3225 |
| 2019/0147801 | A1 * | 5/2019 | Chu | G09G 3/3233 345/76 |
| 2019/0385525 | A1 | 12/2019 | Jin et al. | |
| 2020/0043414 | A1 * | 2/2020 | Wang | G09G 3/3233 |
| 2020/0082767 | A1 * | 3/2020 | Chen | G09G 3/3291 |
| 2020/0202792 | A1 * | 6/2020 | Meng | G09G 3/3233 |
| 2020/0273405 | A1 | 8/2020 | Yang et al. | |

FOREIGN PATENT DOCUMENTS

| | | | |
|---|---|---|---|
| CN | 105931600 | A | 9/2016 |
| CN | 106023892 | A | 10/2016 |
| CN | 106097943 | A | 11/2016 |
| CN | 107093403 | A | 8/2017 |
| CN | 107424549 | A | 12/2017 |
| CN | 107808639 | A | 3/2018 |
| CN | 108806608 | A | 11/2018 |
| KR | 10-2010-0047505 | A | 5/2010 |

OTHER PUBLICATIONS

First Office Action issued in corresponding Chinese Application No. 201810605178.7, dated Sep. 9, 2019, with English language translation.

* cited by examiner

METHOD AND APPARATUS FOR DETECTING THRESHOLD VOLTAGE OF DRIVING TRANSISTOR, AND DISPLAY APPARATUS

CROSS-REFERENCE TO RELATED APPLICATIONS

This application is a Bypass Continuation-in-Part Application of PCT/CN2019/090591 filed Jun. 10, 2019, which claims priority to Chinese Patent Application No. 201810605178.7 filed Jun. 12, 2018, which are incorporated herein by reference in their entirety.

TECHNICAL FIELD

The present disclosure relates to the field of display technologies, and in particular, to a method and an apparatus for detecting a threshold voltage of a driving transistor, and a display apparatus.

BACKGROUND

Organic light-emitting diode (OLED) display panels have been widely used in various electronic devices including computers, mobile phones and other electronic products due to their advantages of self-luminescence, light and thin, low power consumption, high contrast, high color gamut, and flexibility.

SUMMARY

In one aspect, a method for detecting a threshold voltage of a driving transistor is provided. The method for detecting the threshold voltage of the driving transistor includes: obtaining at least one first threshold voltage of at least one driving transistor, each first threshold voltage being a threshold voltage of a corresponding driving transistor obtained when the corresponding driving transistor is driven by a first driving signal; obtaining a threshold reference voltage of the driving transistor according to the at least one first threshold voltage; obtaining a second driving signal of the driving transistor according to the threshold reference voltage and the first driving signal, a value of the second driving signal being greater than a value of the first driving signal; and obtaining a second threshold voltage of the driving transistor, the second threshold voltage being a threshold voltage of the driving transistor obtained when the driving transistor is driven by the second driving signal.

In some embodiments, obtaining the at least one first threshold voltage of the at least one driving transistor, includes: obtaining first threshold voltages of the plurality of driving transistors in the display apparatus.

In some embodiments, obtaining the threshold reference voltage of the driving transistor according to the at least one first threshold voltage, includes: comparing a characteristic value of the plurality of first threshold voltages with the value of the first driving signal or half of the value of the first driving signal, the characteristic value is a value related to the plurality of first threshold voltage; determining the threshold reference voltage of the driving transistor according to a comparison result.

In some embodiments, comparing the characteristic value of the plurality of first threshold voltages with the value of the first driving signal or half of the value of the first driving signal, includes: comparing an average value of the plurality of first threshold voltages with the half of the value of the first driving signal. Determining the threshold reference voltage of the driving transistor according to a comparison result: setting the average value as the threshold reference voltage of the driving transistor in response to a determination of the average value being greater than the half of the value of the first driving signal.

In some embodiments, obtaining the second driving signal of the driving transistor according to the threshold reference voltage and the first driving signal, includes: calculating a sum of the threshold reference voltage and a product of P and the value of the first driving signal to obtain the value of the second driving signal of the driving transistor, wherein P is greater than or equal to 0.5, and less than or equal to 1

In some embodiments, P is equal to 0.5.

In some embodiments, comparing the characteristic value of the plurality of first threshold voltages with the value of the first driving signal or half of the value of the first driving signal, includes: comparing a minimum value of the plurality of first threshold voltages with the half of the value of the first driving signal; and determining the threshold reference voltage of the driving transistor according to a comparison result: setting the minimum value as the threshold reference voltage of the driving transistor in response to a determination of the minimum value being greater than the half of the value of the first driving signal.

In some embodiments, obtaining the second driving signal of the driving transistor according to the threshold reference voltage and the first driving signal, includes: calculating a sum of the threshold reference voltage and the value of the first driving signal to obtain the value of the second driving signal of the driving transistor.

In some embodiments, comparing the characteristic value of the plurality of first threshold voltages with the value of the first driving signal or half of the value of the first driving signal, includes: comparing a maximum value of the plurality of first threshold voltages with the value of the first driving signal; and determining the threshold reference voltage of the driving transistor according to a comparison result: setting the maximum value as the threshold reference voltage of the driving transistor in response to a determination of the maximum value being equal to the value of the first driving signal.

In some embodiments, obtaining the second driving signal of the driving transistor according to the threshold reference voltage and the first driving signal, includes: calculating a sum of the threshold reference voltage and a product of M and the value of the first driving signal to obtain the value of the second driving signal of the driving transistor, wherein M is greater than 0 and less than or equal to 0.5.

In some embodiments, M is equal to 0.5.

In some embodiments, obtaining the at least one first threshold voltage of the at least one driving transistor, includes: obtaining a first threshold voltage of the driving transistor.

In some embodiments, obtaining the threshold reference voltage of the driving transistor according to the at least one first threshold voltage, includes: comparing the first threshold voltage with the value of the first driving signal; and determining the threshold reference voltage of the driving transistor according to a comparison result: setting a product of N and the value of the first driving signal as the threshold reference voltage of the driving transistor in response to a determination of the first threshold voltage being equal to the value of the first driving signal, wherein N is greater than 0 and less than or equal to 1.

In some embodiments, obtaining the second driving signal of the driving transistor according to the threshold reference voltage and the first driving signal, includes: calculating a sum of the threshold reference voltage and the value of the first driving signal to obtain the value of the second driving signal of the driving transistor.

In another aspect, an apparatus for detecting a threshold voltage of a driving transistor is provided. The apparatus includes at least one source voltage obtaining circuit and a processor electrically connected to each source voltage obtaining circuit. Each source voltage obtaining circuit is configured to electrically connect to a driving transistor of at least one driving transistor, and detect a source voltage of a corresponding driving transistor. the processor is configured to: obtain at least one first threshold voltage of the at least one driving transistor according to at least one source voltage detected by the at least one source voltage obtaining circuit respectively, each first threshold voltage being a threshold voltage of a corresponding driving transistor obtained when the corresponding driving transistor is driven by a first driving signal; obtain a threshold reference voltage of the driving transistor according to the at least one first threshold voltage; obtain a second driving signal of the driving transistor according to the threshold reference voltage and the at least one first driving signal, a value of the second driving signal being greater than a value of the first driving signal corresponding to a same driving transistor; and obtain a second threshold voltage of the driving transistor according to a source voltage detected by a source voltage obtaining circuit and the second driving signal, the second threshold voltage being a threshold voltage of the driving transistor obtained when the driving transistor is driven by the second driving signal.

In some embodiments, the apparatus further includes a memory configured to store at least one first driving signal. the processor is configured to obtain the at least one first threshold voltage of the at least one driving transistor according to the at least one source voltage detected by the at least one source voltage obtaining circuit respectively and at least one first driving signal stored in the memory.

In yet another aspect, a display apparatus is provided. The display apparatus includes the apparatus for detecting the threshold voltage of the driving transistor as described above.

In yet another aspect, a computer product is provided. The computer product includes one or more processors. The one or more processors are configured to execute computer instructions to perform one or more steps in the method for detecting the threshold voltage of the driving transistor as described above.

In yet another aspect, a non-transitory computer-readable storage medium is provided. The non-transitory computer-readable storage medium stores computer instructions that are configured to perform the method for detecting the threshold voltage of the driving transistor as described above.

In yet another aspect, a computer program is provided. After the computer program is loaded into a processor, the computer program causes the processor to perform the method for detecting the threshold voltage of the driving transistor as described above.

BRIEF DESCRIPTION OF THE DRAWINGS

In order to describe technical solutions in some embodiments of the present disclosure more clearly, the accompanying drawings to be used in the description of some embodiments will be introduced below briefly. Obviously, the accompanying drawings to be described below are merely some embodiments of the present disclosure, and a person of ordinary skill in the art can obtain other drawings according to these drawings without paying any creative effort.

DETAILED DESCRIPTION

Figure 1:
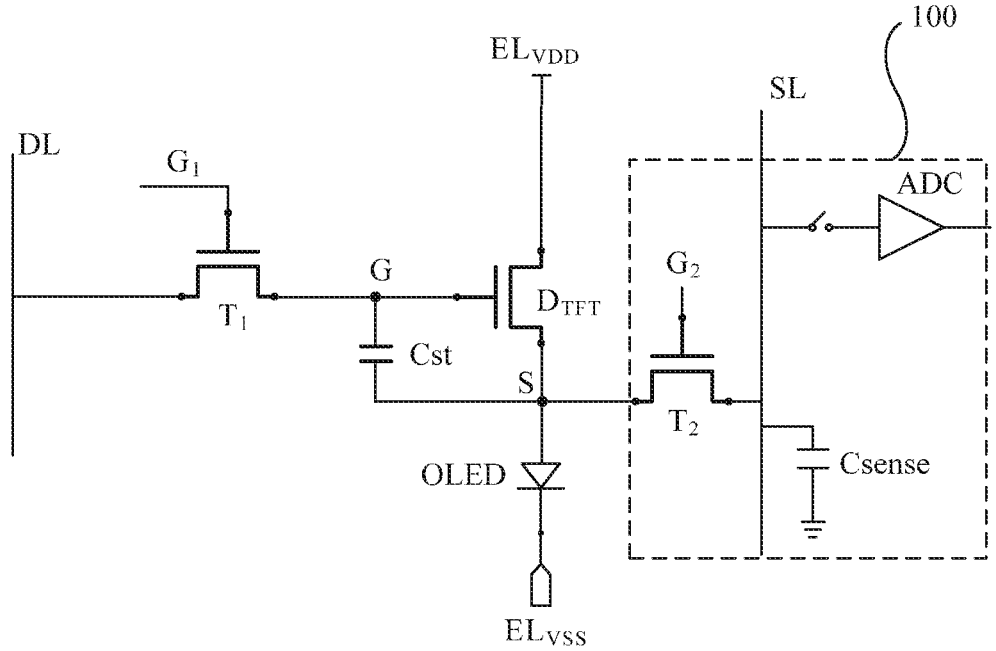
FIG. 1 is a diagram showing a pixel driving circuit in a display apparatus, according to some embodiments of the present disclosure.

The technical solutions in some embodiments of the present disclosure will be described clearly and completely below with reference to the accompanying drawings in some embodiments of the present disclosure. Obviously, the described embodiments are merely some but not all of embodiments of the present disclosure. All other embodiments made on the basis of some embodiments of the present disclosure by a person of ordinary skill in the art without paying any creative effort shall be included in the protection scope of the present disclosure.

Unless otherwise defined, technical or scientific terms used in some embodiments of the present disclosure shall have the ordinary meanings understood by those with ordinary skills in the field to which this disclosure belongs. Terms "first", "second" and similar words used in some embodiments of the present disclosure do not indicate any order, quantity, or importance, but are merely used to distinguish different components. Words such as "include" or "comprise" mean that the element or item appearing before the word covers the element(s) or item(s) appearing after the word and the equivalent thereof without excluding other elements or items.

Each sub-pixel in a display area AA of an organic light-emitting diode (OLED) display panel is generally provided with an OLED and a pixel driving circuit electrically connected to the OLED. Each pixel driving circuit includes at least a driving transistor $D_{TFT}$, so that the driving transistor $D_{TFT}$ controls a current that flows through a corresponding OLED and therefore controls a brightness of the OLED. However, in practice, different driving transistors $D_{TFT}$ in the OLED display panel have different electrical properties (mainly including threshold voltages) due to the influence of factors such as manufacturing process and production conditions. As a result, the driving transistors $D_{TFT}$ in different sub-pixels may output different currents to corresponding OLEDs when driven by a same driving voltage, causing the OLEDs in different sub-pixels to emit light of different brightness.

As such, by detecting the threshold voltages of different driving transistors $D_{TFT}$ and compensating display signals of different sub-pixels through external compensation, it is possible to solve a problem of uneven display brightness of the OLED display panel caused by a difference in threshold voltages of the driving transistors $D_{TFT}$.

To obtain the threshold voltage of each driving transistor $D_{TFT}$, a voltage at a gate G and a voltage at a source S of the driving transistor $D_{TFT}$ are detected and a difference therebetween is calculated. For example, the voltage $V_G$ at the gate G of the driving transistor $D_{TFT}$ is equal to the driving voltage of the driving transistor $D_{TFT}$, and the voltage $V_S$ at the source S of the driving transistor $D_{TFT}$ is obtained through the detection. The threshold voltage Vth of the driving transistor $D_{TFT}$ is equal to a difference between the voltage $V_G$ and the voltage $V_S$, i.e., $Vth=V_G-V_S$. In this case, it will be understood that an upper limit of the threshold voltage Vth of each driving transistor $D_{TFT}$ should not exceed its driving voltage $V_G$.

However, as the OLED display panel emits light for a long time, the threshold voltage of each driving transistor $D_{TFT}$ is prone to a large forward shift. That is, the threshold voltage of each driving transistor $D_{TFT}$ increases, and the threshold voltages Vth of some driving transistors $D_{TFT}$ may be greater than corresponding driving voltages $V_G$. Once this situation occurs, it is difficult to accurately detect the threshold voltage Vth of the corresponding driving transistor $D_{TFT}$ using the threshold voltage detection method in the related art. Therefore, it is difficult to effectively compensate voltages of the OLEDs in the OLED display panel. That is, the OLED display panel still has the problem of uneven brightness.

On this basis, some embodiments of the present disclosure provide a method for detecting a threshold voltage of a driving transistor. Referring to FIG. 1, in an example where the driving transistor is a driving transistor $D_{TFT}$ in an OLED display panel (of course it is not limited thereto, and it is allowable that the driving transistor is a driving transistor in a quantum dot display panel, etc.).

The OLED display panel includes a plurality of sub-pixels each provided with a pixel driving circuit. As shown in FIG. 1, the pixel driving circuit includes, for example, a first transistor $T_1$, a driving transistor $D_{TFT}$, and a first capacitor Cst. A gate of the first transistor $T_1$ is connected to a first gate line $G_1$, and a source of the first transistor $T_1$ is connected to a data line DL. A drain of the first transistor $T_1$, a gate of the driving transistor $D_{TFT}$ and a first electrode of the first capacitor Cst are connected to a first node G. A drain of the driving transistor $D_{TFT}$ is connected to a power supply voltage line $EL_{VDD}$. A source of the driving transistor $D_{TFT}$, a second electrode of the first capacitor Cst, and an anode of an OLED in a same sub-pixel are connected to a second node S. A cathode of the OLED is connected to a common voltage signal line $EL_{VSS}$. Of course, some embodiments of the present disclosure are not limited to the above pixel driving circuit. That is, the method for detecting the threshold voltage of the driving transistor provided in some embodiments of the present disclosure is applicable to a pixel driving circuit having other structures.

Figure 2:
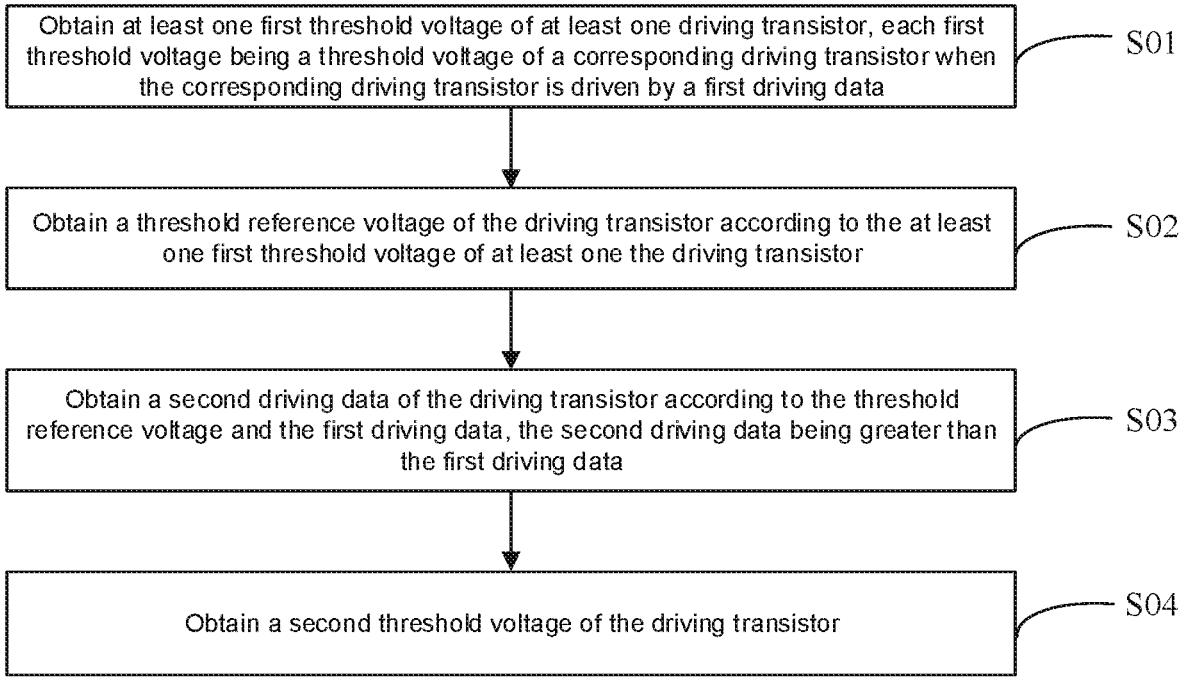
FIG. 2 is a flow chart of a method for detecting a threshold voltage of a driving transistor, according to some embodiments of the present disclosure.

As shown in FIG. 2, the method for detecting the threshold voltage of the driving transistor $D_{TFT}$ includes S01 to S04.

In S01, at least one first threshold voltage of at least one driving transistor is obtained. Each first threshold voltage is a threshold voltage of a corresponding driving transistor when the corresponding driving transistor is driven by a first driving signal.

The at least one driving transistor may include one driving transistor in the OLED display panel, or some of the driving transistors in the OLED display panel, or all of the driving transistors in the OLED display panel. In addition, the at least one transistor may include or not include the driving transistor $D_{TFT}$. With regard to structure and connection of the at least one driving transistor, reference may be made to the driving transistor $D_{TFT}$. In addition, each first threshold voltage may be obtained when the driving transistor is driven by a corresponding first driving signal. That is, values of first driving signals of different driving transistors may be different or the same, or only part of values of first driving signals of different driving transistors may be same.

A threshold voltage obtaining circuit 100 configured to detect the voltage at the source of the driving transistor includes a second transistor $T_2$, a second capacitor Csense, and an analog-to-digital converter ADC. A drain of the second transistor $T_2$ is connected to the second node S, a gate of the second transistor $T_2$ is connected to a second gate line G2, and a source of the second transistor $T_2$ is connected to a sensing line SL. A first electrode of the second capacitor Csense is connected to the sensing line SL, and a second electrode of the second capacitor Csense is grounded. The analog-to-digital converter ADC is connected to the sensing line SL through a control switch.

Figure 7:
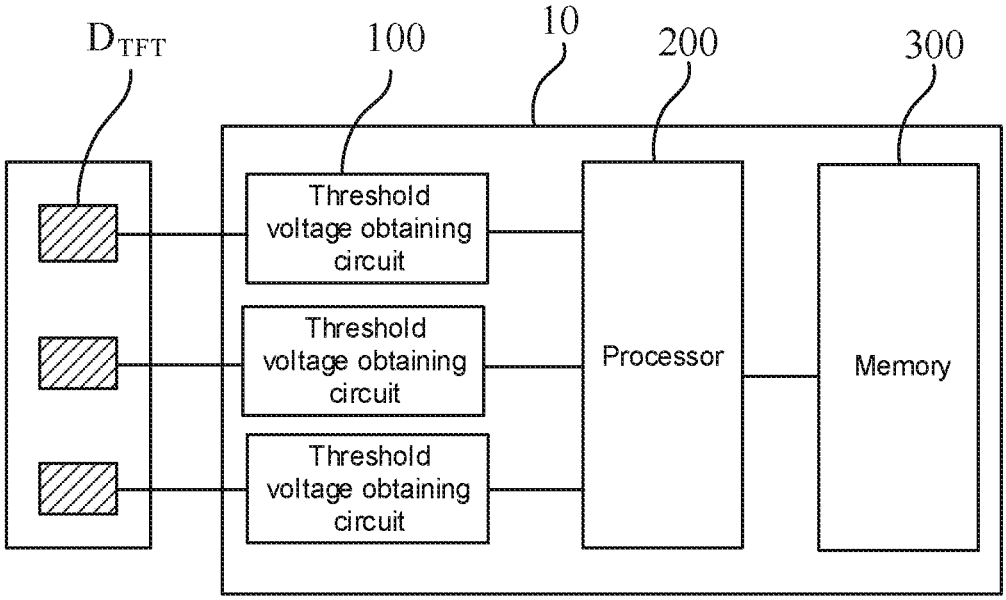
FIG. 7 is a schematic diagram of an apparatus for detecting a threshold voltage of a driving transistor, according to some embodiments of the present disclosure.

For example, referring to FIG. 7, the source voltage obtaining circuit 100 is connected to a processor 200. Here, the processor 200 calculates the first threshold voltage of the driving transistor according to the voltage at the source of the driving transistor detected by the source voltage obtaining circuit 100 and the driving voltage of the driving transistor (that is, a voltage provided by the data line DL).

Taking the driving transistor $D_{TFT}$ as example and referring to FIG. 1, the above process of obtaining the voltage at the source of the driving transistor $D_{TFT}$ includes an initialization stage and a charging stage.

In the initialization stage: scanning signals are input to the first gate line $G_1$ and the second gate line $G_2$ to control the first transistor $T_1$ and the second transistor $T_2$ to be turned on; the first driving signal $V_{data1}$ is input to the gate of the driving transistor $D_{TFT}$ (i.e., the first electrode of the first capacitor Cst) through the data line DL (for example, the first driving signal $V_{data1}$ is 3 V, then $V_G=V_{data1}=3$ V); and a reset voltage $V_0$ (for example, the reset voltage $V_0$ is 0 V) is input to the source of the driving transistor $D_{TFT}$ through the sensing line SL, that is, $V_S=V_0$, so as to reset the source of the driving transistor $D_{TFT}$.

In the charging stage: the first transistor $T_1$ and the second transistor $T_2$ are controlled to remain in a turned-on state, and the first driving signal $V_{data1}$ stored in the first capacitor Cst controls the driving transistor $D_{TFT}$ to be turned on; and the power supply voltage line $EL_{VDD}$ charges the second capacitor Csense through the second transistor $T_2$.

On this basis, the analog-to-digital converter ADC receives a charging voltage of the second capacitor Csense, which is almost equal to the voltage $V_S$ at the source of the driving transistor $D_{TFT}$. As a result, the voltage $V_S$ at the source of the driving transistor $D_{TFT}$ is obtained by the source voltage obtaining circuit 100. Then, the processor 200 may calculate the first threshold voltage $V_{th1}$ of the driving transistor $D_{TFT}$ by subtracting the voltage $V_S$ at the source of the driving transistor $D_{TFT}$ from the voltage $V_G$ at the gate of the driving transistor $D_{TFT}$ (i.e., the value of the first driving signal $V_{data1}$), and the formula is: $V_{th1}=V_G-V_S$.

In S02, a threshold reference voltage $V_{ref}$ of the driving transistor $D_{TFT}$ is obtained according to the at least one first threshold voltage of the at least one driving transistor.

In S03, a second driving signal $V_{data2}$ of the driving transistor $D_{TFT}$ is obtained according to the threshold reference voltage $V_{ref}$ and a first driving signal $V_{data1}$ applied to the driving transistor $D_{TFT}$, a value of the second driving signal $V_{data2}$ being greater than a value of the first driving signal $V_{data1}$.

In S04, a second threshold voltage $V_{th2}$ of the driving transistor $D_{TFT}$ is obtained, the second threshold voltage $V_{th1}$ being a threshold voltage of the driving transistor $D_{TFT}$ obtained when the driving transistor $D_{TFT}$ is driven by the second driving signal $V_{data2}$.

It will be understood herein that if a driving signal corresponding to the driving transistor $D_{TFT}$ is fixed, in a case where an actual threshold voltage of the driving transistor $D_{TFT}$ exceeds a pre-set detection range of the threshold voltage (i.e., exceeds the first driving signal $V_{data1}$), the driving transistor $D_{TFT}$ will not be turned on. In this case, the second capacitor Csense will not be charged, and the voltage $V_S$ at the source of the driving transistor $D_{TFT}$ detected by the analog-to-digital converter ADC in the source voltage obtaining circuit is 0 V. As a result, the threshold voltage detected by the source voltage obtaining circuit is 3 V (i.e., the upper limit of the pre-set detection range of the threshold voltage). In this way, the first threshold voltage $V_{th1}$ obtained according to the first driving signal $V_{data1}$ is not equal to the actual threshold voltage.

In some embodiments of the present disclosure, after the threshold reference voltage $V_{ref}$ of the driving transistor $D_{TFT}$ is obtained according to the at least one first threshold voltage, the second driving signal $V_{data2}$, a value of which is greater than the value of the first driving signal $V_{data1}$, of the driving transistor $D_{TFT}$ may be obtained according to the threshold reference voltage $V_{ref}$ and the first driving signal $V_{data1}$ of the driving transistor $D_{TFT}$. In this case, the second driving signal $V_{data2}$ is used to obtain the second threshold voltage $V_{th2}$ of the driving transistor $D_{TFT}$. Of course, it will be understood that, as for the process of obtaining the second threshold voltage $V_{th2}$ in S04, reference may be made to the process of obtaining the first threshold voltage $V_{th1}$ in S01. That is, same initialization and charging stages may be adopted after the first driving signal $V_{data1}$ is updated to the second driving signal $V_{data2}$.

In summary, in some embodiments of the present disclosure, the threshold voltage corresponding to a same driving transistor $D_{TFT}$ may be obtained twice using the first driving signal $V_{data1}$ and the second driving signal $V_{data2}$, which may avoid a problem that the actual threshold voltage of the driving transistor $D_{TFT}$ cannot be effectively detected in a case where only the first threshold voltage $V_{th1}$ of the driving transistor $D_{TFT}$ is obtained according to the first driving signal $V_{data1}$.

In addition, in some embodiments of the present disclosure, the threshold reference voltage $V_{ref}$ of the driving transistor $D_{TFT}$ is determined according to the at least one first threshold voltage, then the second driving signal $V_{data2}$ is obtained according to the threshold reference voltage $V_{ref}$ and the first driving signal $V_{data1}$ of the driving transistor $D_{TFT}$, and it is ensured that the value of the second driving signal $V_{data2}$ is greater than the value of the first driving signal $V_{data1}$. In this way, the detection range of the threshold voltage is increased, which may significantly reduce a probability of the threshold voltage exceeding the detection range. That is, a detection accuracy of the threshold voltage of the driving transistor $D_{TFT}$ is increased. Therefore, it may be possible to effectively compensate the threshold voltage of the driving transistor $D_{TFT}$ according to the second threshold voltage $V_{th2}$ that is determined according to the second driving signal $V_{data2}$, so as to improve a display uniformity of a display apparatus in which the driving transistor $D_{TFT}$ is located.

In some embodiments, the at least one driving transistor includes a plurality of driving transistors. For example, obtaining the at least one first threshold voltage of the at least one driving transistor in the S01 includes: obtaining first threshold voltages of the plurality of driving transistors in the display apparatus (e.g., a display panel), for example, one by one. In some examples, the plurality of driving transistors are all the driving transistors in the display apparatus. In some other examples, the plurality of driving transistors are only some of driving transistors in the display apparatus. For example, the plurality of driving transistors are at least two driving transistors in a region with uneven brightness of the display apparatus. In some embodiments of the present disclosure, the number of the plurality of driving transistors and the region where they are located are not limited, and they may be set according to actual needs.

It is to be noted that in a case where threshold voltages of other driving transistors in the OLED display panel need to be detected, the threshold reference voltage $V_{ref}$ of the driving transistor $D_{TFT}$ obtained in S02 may be used as a threshold reference voltage of the other driving transistors, thereby omitting the step of obtaining the threshold reference voltage for the other driving transistors. In addition, the other driving transistors may share a same first driving signal as the driving transistor $D_{TFT}$ during the process of obtaining second threshold voltages of the other driving transistors.

Some following embodiments are further illustrations by taking an example in which the first threshold voltages of all the driving transistors in the display apparatus are obtained one by one.

In some embodiments, the S02 of obtaining the threshold reference voltage $V_{ref}$ of the driving transistor $D_{TFT}$ according to the at least one first threshold voltage includes: comparing a characteristic value of the plurality of first threshold voltages with the value of the first driving signal or half of the value of the first driving signal, and determining the threshold reference voltage $V_{ref}$ of the driving transistor $D_{TFT}$ according to a comparison result. Here, the characteristic value of the plurality of first threshold voltages may a value related to the plurality of first threshold voltage such as a an average value, a minimum value, a maximum value or a median value of the plurality of first threshold voltages.

For example, the S02 of obtaining the threshold reference voltage $V_{ref}$ of the driving transistor $D_{TFT}$ according to the at least one first threshold voltage of the at least one driving transistor includes: determining the threshold reference voltage $V_{ref}$ according to an average value of the at least one first threshold voltages of the plurality of driving transistors in the display apparatus. In some other examples, the S02 of obtaining the threshold reference voltage $V_{ref}$ of the driving transistor $D_{TFT}$ according to the at least one first threshold voltage of the at least one driving transistor includes: determining the threshold reference voltage $V_{ref}$ according to a minimum value, a maximum value, or a median value of the first threshold voltages of the plurality of driving transistors in the OLED display apparatus, which is not limited in some embodiments of the present disclosure, and may be selected and set according to actual needs.

In addition, the obtained threshold reference voltage $V_{ref}$ is applicable to, for example, all driving transistors in the display apparatus. That is, all the driving transistors in the display apparatus correspond to a same threshold reference voltage. Or, the obtained threshold reference voltage $V_{ref}$ is applicable to, for example, a single driving transistor $D_{TFT}$. With regard to how to set the threshold reference voltage $V_{ref}$, reference may be made to relevant description in solutions provided in subsequent embodiments.

As the manner of obtaining the threshold reference voltage $V_{ref}$ differs, the manner of obtaining the second driving signal $V_{data2}$ of the driving transistor $D_{TFT}$ according to the threshold reference voltage $V_{ref}$ and the first driving signal $V_{data1}$ in S03 is also different. However, no matter which manner is adopted, the value of the second driving signal $V_{data2}$ obtained in S03 should be greater than the value of the first driving signal $V_{data1}$ corresponding to the same driving transistor $D_{TFT}$.

It will be added that, in some embodiments of the present disclosure, the threshold voltages (including the first threshold voltage $V_{th1}$ and the second threshold voltage $V_{th2}$) are detected when the screen is black. That is to say, the threshold voltages of the driving transistors $D_{TFT}$ detected in some embodiments of the present disclosure are threshold voltages detected when the screen is not displaying an image.

According to different manners of obtaining the threshold reference voltage $V_{ref}$, the method for detecting the threshold voltage of the driving transistor is further described below with examples.

Figure 3:
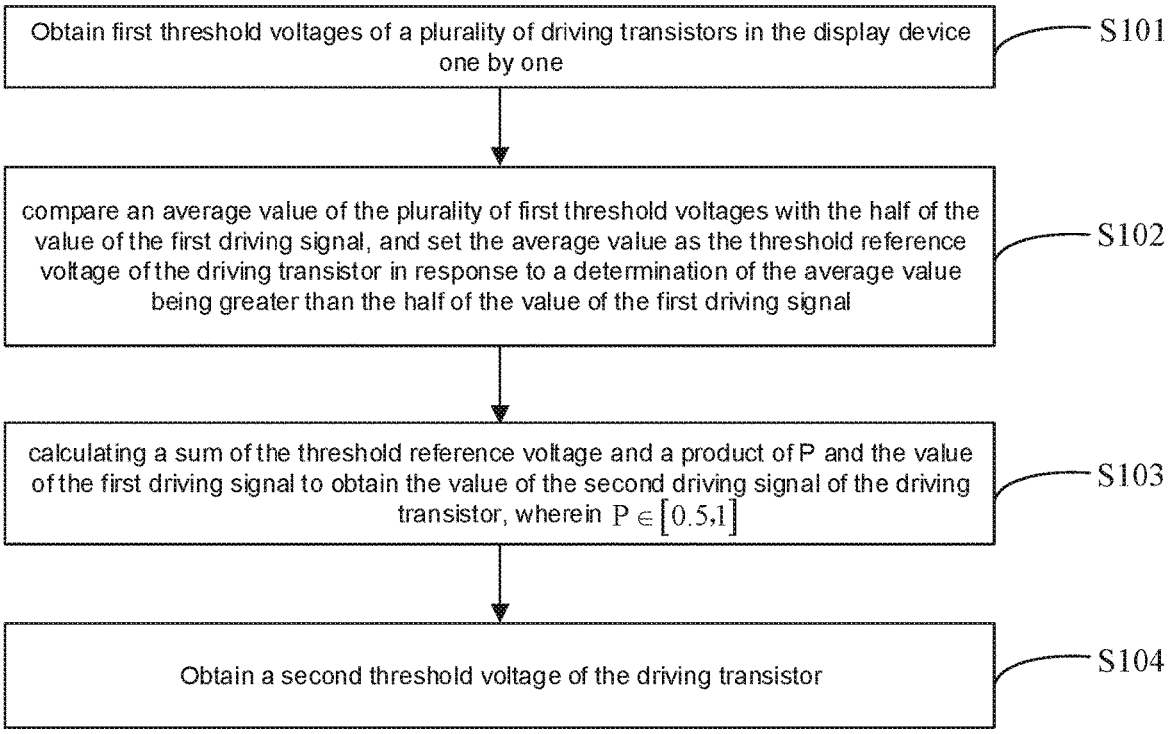
FIG. 3 is a flow chart of another method for detecting a threshold voltage of a driving transistor, according to some embodiments of the present disclosure.

In some embodiments, referring to FIG. 3, the method for detecting the threshold voltage of the driving transistor $D_{TFT}$ includes S101 to S104.

In S101, first threshold voltages of a plurality of driving transistors in a display apparatus are obtained one by one, each first threshold voltage being a threshold voltage of a corresponding driving transistor when the corresponding driving transistor is driven by a corresponding first driving signal.

In S102, an average value $V_{avg}$ of the plurality of first threshold voltages is compared with the half of the value of the first driving signal $V_{data1}$ of the driving transistor $D_{TFT}$, and the average value $V_{avg}$ is set as the threshold reference voltage $V_{ref}$ of the driving transistor $D_{TFT}$ (i.e., $V_{ref}=V_{avg}$) in response to a determination of the average value $V_{avg}$ being greater than the half of the value of the first driving signal $V_{data1}$ (i.e., $V_{avg}>0.5V_{data1}$).

It will be noted that the average value $V_{avg}$ of the first threshold voltages is an arithmetic average value, a geometric average value, a square average value, or a weighted average value, which is not limited in some embodiments of the present disclosure and may be set according to actual needs.

In S103, a sum of the threshold reference voltage $V_{ref}$ and a product of P and the value of the first driving signal $V_{data1}$ is calculated to obtain the value of the second driving signal $V_{data2}$ of the driving transistor $D_{TFT}$, (that is, $V_{data2}=V_{ref}+P\cdot V_{data1}=V_{avg}+P\cdot V_{data1}$), wherein P is greater than or equal to 0.5, and less than or equal to 1 (that is, $P\in[0.5, 1]$).

In some examples, P is equal to 0.5 (that is, P=0.5). In this case, $V_{data2}=V_{avg}+0.5\cdot V_{data1}$. Since $V_{avg}>0.5V_{data1}$, then $V_{data2}>V_{data1}$. As a result, a detection range of the threshold voltage of the driving transistor $D_{TFT}$ may be increased. Moreover, the second threshold voltage $V_{th2}$ of the driving transistor $D_{TFT}$ when the driving transistor $D_{TFT}$ is driven by the second driving signal $V_{data2}$ is obtained. In this way, it may be possible to significantly reduce the probability of the threshold voltage exceeding the detection range and improve the detection accuracy of the threshold voltage of the driving transistor $D_{TFT}$, so as to effectively compensate the threshold voltage of the driving transistor $D_{TFT}$.

Herein, it is set that $V_{avg}>0.5V_{data1}$ based on the following reason: if the average value of the first threshold voltages of the plurality of driving transistors is greater than half of the first driving signal $V_{data1}$, it means that the first threshold voltages of the plurality of driving transistors on the whole are shifted forward to a certain degree, and there may easily be a risk of uneven brightness in the display apparatus where the plurality of driving transistors are located. Therefore, by adjusting the detection range of the threshold voltage, i.e., by using the method for detecting the threshold voltage of the driving transistor provided in some embodiments of the present disclosure, it is possible to increase the detection range of the threshold voltage to accurately detect the second threshold voltages (i.e., the actual threshold voltages) of the plurality of driving transistors.

In S104, a second threshold voltage $V_{th2}$ of the driving transistor $D_{TFT}$ is obtained, the second threshold voltage $V_{th2}$ being a threshold voltage of the driving transistor $D_{TFT}$ obtained when the driving transistor $D_{TFT}$ is driven by the second driving signal $V_{data2}$.

In some examples, referring to FIG. 1 and the process (including the initialization stage and the charging stage) of detecting the threshold voltage of the driving transistor $D_{TFT}$ described above, if $V_{data1}$ is 3V, then in a case where the threshold voltages of the plurality of driving transistors are shifted forward on the whole, the threshold voltages of some of the plurality of driving transistors will exceed 3V and will be, for example, 4V. Since an initial detection range of the threshold voltage (not exceeding the first driving signal $V_{data1}$) is 0~3 V, for the driving transistor $D_{TFT}$ with an actual threshold voltage of 4V, the first threshold voltage $V_{th1}$ obtained according to its first driving signal $V_{data1}$ is 3V (reference may be made to description of corresponding parts in the foregoing embodiments).

In this case, the average value $V_{avg}$ of the first threshold voltages of the plurality of driving transistors is obtained. For example, $V_{avg}=2$ V ($>0.5\cdot V_{data1}$). Then, the average value $V_{avg}$ is set as the threshold reference voltage $V_{ref}$. Therefore, the value of the second driving signal is $V_{data2}=V_{ref}+0.5\cdot V_{data1}=4.5$V. In this way, driven by the second driving signal $V_{data2}$, the driving transistor $D_{TFT}$ to be detected is controlled to be turned on, and the second capacitor Csense in the source voltage obtaining circuit is charged to 0.5 V. Therefore, the second threshold voltage $V_{th2}$ may be obtained $V_{th2}=V_G-V_S=V_{data2}-V_{sense}=4$V. As such, after the detection range of the threshold voltage is increased, it may be possible to accurately detect the actual threshold voltage of the corresponding driving transistor $D_{TFT}$.

Figure 4:
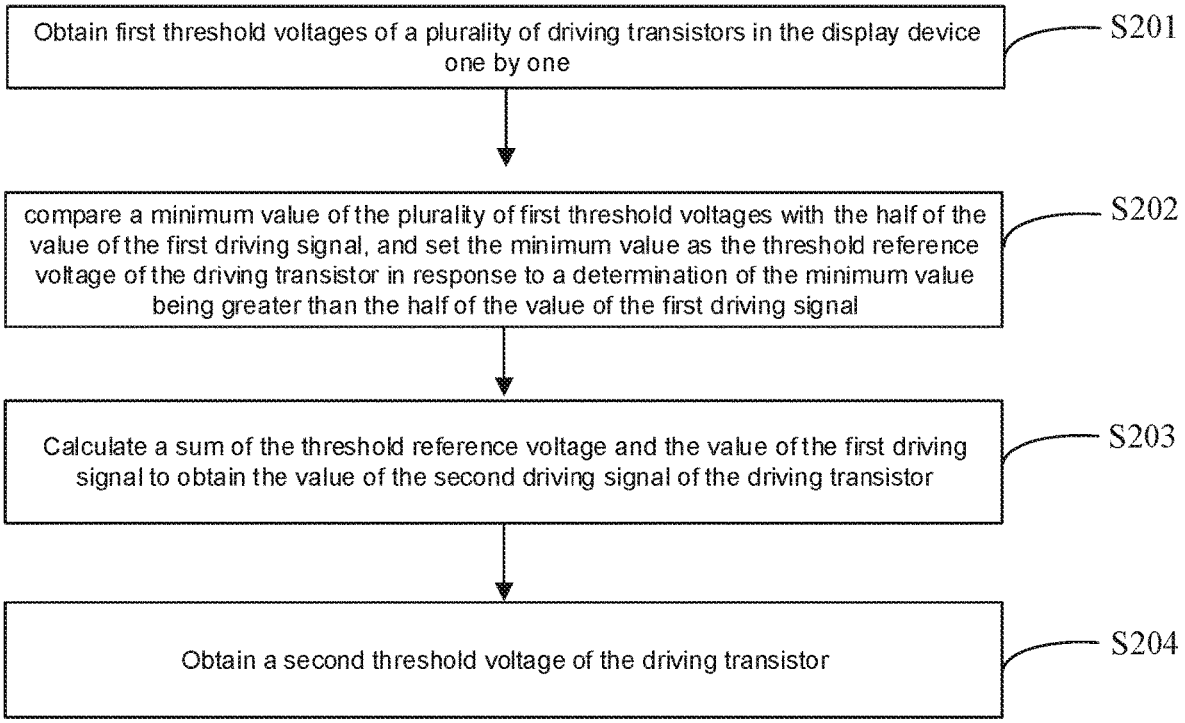
FIG. 4 is a flow chart of yet another method for detecting a threshold voltage of a driving transistor, according to some embodiments of the present disclosure.

In some other embodiments, referring to FIG. 4, the method for detecting the threshold voltage of the driving transistor $D_{TFT}$ includes S201 to S204.

In S201, first threshold voltages of a plurality of driving transistors in a display apparatus are obtained one by one, each first threshold voltage being a threshold voltage of a corresponding driving transistor when the corresponding driving transistor is driven by a corresponding first driving signal.

In S202, a minimum value $V_{min}$ of the plurality of first threshold voltages is compared with the half of the value of the first driving signal $V_{data1}$ of the driving transistor $D_{TFT}$, and the minimum value $V_{min}$ is set as the threshold reference voltage $V_{ref}$ of the driving transistor $D_{TFT}$ (i.e., $V_{ref}=V_{min}$) in response to a determination of the minimum value $V_{min}$ being greater than the half of the value of the first driving signal $V_{data1}$ (i.e., $V_{min}>0.5V_{data1}$).

In S203, a sum of the threshold reference voltage $V_{ref}$ and the value of the first driving signal $V_{data1}$ is calculated to obtain the value of the second driving signal $V_{data2}$ of the driving transistor $D_{TFT}$ (that is, $V_{data2}=V_{ref}+V_{data1}=V_{min}+V_{data1}$).

It will be understood here that there is necessarily a threshold voltage for any driving transistor (that is, $V_{min}\neq 0$). Therefore, no matter what the minimum value $V_{min}$ of the first threshold voltages of the plurality of driving transistors is, $V_{data2}$ is necessarily greater than $V_{data1}$. In this way, the detection range of the threshold voltage may be effectively increased.

In S204, a second threshold voltage $V_{th2}$ of the driving transistor $D_{TFT}$ is obtained, the second threshold voltage $V_{th2}$ being a threshold voltage of the driving transistor $D_{TFT}$ obtained when the driving transistor $D_{TFT}$ is driven by the second driving signal $V_{data2}$.

In some embodiments, after the second driving signal $V_{data2}$ is obtained, the second threshold voltage $V_{th2}$ of the driving transistor $D_{TFT}$ when the driving transistor $D_{TFT}$ is driven by the second driving signal $V_{data2}$ is obtained. In this way, it may be possible to significantly reduce the probability of the threshold voltage exceeding the detection range and improve the detection accuracy of the threshold voltage of the driving transistor $D_{TFT}$, so as to effectively compensate the threshold voltage of the driving transistor $D_{TFT}$.

In some examples, referring to FIG. 1 and the process (including the initialization stage and the charging stage) of detecting the threshold voltage of the driving transistor $D_{TFT}$ described above, if the first driving signal $V_{data1}$ is 3 V, then in the case where the threshold voltages of the plurality of driving transistors are shifted forward on the whole, the threshold voltages of some of the plurality of driving transistors will exceed 3 V and will be, for example, 4 V. Since the initial detection range of the threshold voltage (not exceeding the first driving signal $V_{data1}$) is 0~3 V, for the driving transistor $D_{TFT}$ with an actual threshold voltage of 4V, the first threshold voltage $V_{th1}$ obtained according to its first driving signal $V_{data1}$ is 3 V (reference may be made to description of corresponding parts in the foregoing embodiments).

In this case, the minimum value $V_{min}$ of the first threshold voltages of the plurality of driving transistors is obtained ($V_{min}$=1.5 V), and the minimum value $V_{min}$ is set as the threshold reference voltage $V_{ref}$. Accordingly, the second driving signal is $V_{data2}=V_{ref}+V_{data1}$=4.5V. In this way, driven by the second driving signal $V_{data2}$, the driving transistor to be detected $D_{TFT}$ is controlled to be turned on, and the second capacitor Csense in the source voltage obtaining circuit is charged to 0.5 V. The second threshold voltage $V_{th2}$ (i.e., the actual threshold voltage) may be obtained: $V_{th2}=V_G-V_S=V_{data2}-V_{sense}$=4V. As such, after the detection range of the threshold voltage is increased, it may be possible to accurately detect the actual threshold voltage of the driving transistor $D_{TFT}$.

It will be noted that, it is for illustrative purposes only that the minimum value $V_{min}$ of the first threshold voltages of the plurality of driving transistors is set to be equal to 1.5 V. In some other examples, the minimum first threshold voltage $V_{min}$ among the first threshold voltages of the plurality of driving transistors is obtained according to actual detection results and is, for example, 0.5 V, 1 V, or 2 V.

In addition, in S202, the minimum value $V_{min}$ of the first threshold voltages of the plurality of driving transistors is set as the threshold reference voltage $V_{ref}$ of the driving transistor $D_{TFT}$ in a case where the minimum value $V_{min}$ of the first threshold voltages of the plurality of driving transistors is greater than or equal to half of the first driving signal $V_{data1}$ of the driving transistor $D_{TFT}$. Therefore, the detection accuracy of the threshold voltage of the driving transistor $D_{TFT}$ may be further improved.

Figure 5:
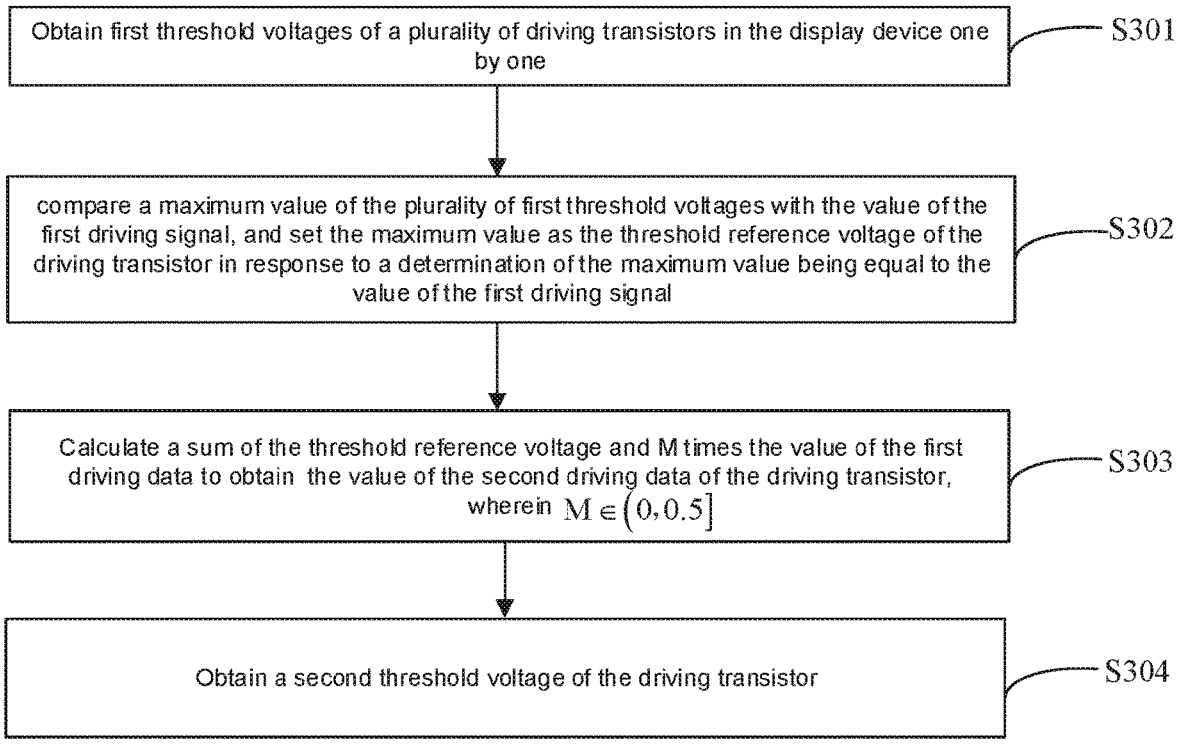
FIG. 5 is a flow chart of yet another method for detecting a threshold voltage of a driving transistor, according to some embodiments of the present disclosure.

In some other embodiments, referring to FIG. 5, the method for detecting the threshold voltage of the driving transistor $D_{TFT}$ includes S301 to S304.

In S301, first threshold voltages of a plurality of driving transistors in a display apparatus are obtained one by one, each first threshold voltage being a threshold voltage of a corresponding driving transistor when the corresponding driving transistor is driven by a corresponding first driving signal.

In S302, a maximum value $V_{max}$ of the first threshold voltages of the plurality of driving transistors is compared with the value of the first driving signal $V_{data1}$ of the driving transistor $D_{TFT}$, and the maximum value $V_{max}$ is set as the threshold reference voltage $V_{ref}$ of the driving transistor $D_{TFT}$ (i.e., $V_{ref}=V_{max}$) in response to a determination of the maximum value $V_{max}$ being equal to the value of the first driving signal $V_{data1}$ (i.e., $V_{max}=0.5V_{data1}$).

In S303, a sum of the threshold reference voltage $V_{ref}$ and a product of M and the value of the first driving signal $V_{data1}$ is calculated to obtain the value of the second driving signal $V_{data2}$ of the driving transistor $D_{TFT}$ (that is, $V_{data2}=V_{ref}+M\cdot V_{data1}=V_{max}+M\cdot V_{data1}$), wherein M is greater than 0 and less than or equal to 0.5 (that is, $M\in(0, 0.5]$).

In some examples, M is equal to 0.5 (that is, M=0.5). In this case, $V_{data2}=V_{max}+0.5\cdot V_{data1}$.

In S304, a second threshold voltage $V_{th2}$ of the driving transistor $D_{TFT}$ is obtained, the second threshold voltage $V_{th2}$ being a threshold voltage of the driving transistor $D_{TFT}$ obtained when the driving transistor $D_{TFT}$ is driven by the second driving signal $V_{data2}$.

With regard to how the detection range of the threshold voltage is increased in embodiments of the present disclosure, reference may be made to corresponding description in some foregoing embodiments, and details will not be repeated here.

Figure 6:
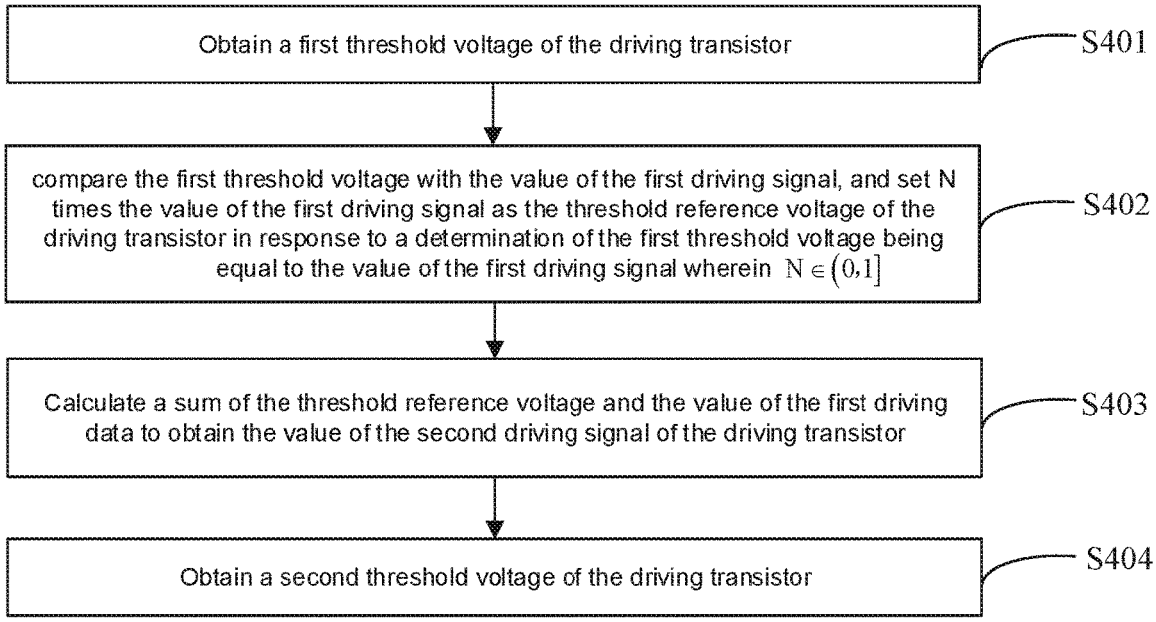
FIG. 6 is a flow chart of yet another method for detecting a threshold voltage of a driving transistor, according to some embodiments of the present disclosure.

In some other embodiments, the at least one driving transistor include one driving transistor $D_{TFT}$. Referring to FIG. 6, the method for detecting the threshold voltage of the driving transistor $D_{TFT}$ includes S401 to S404.

In S401, a first threshold voltage $V_{th1}$ of the driving transistor $D_{TFT}$ is obtained, the first threshold voltage $V_{th1}$ being a threshold voltage of the driving transistor $D_{TFT}$ when the driving transistor $D_{TFT}$ is driven by the first driving signal $V_{data1}$.

In S402, the first threshold voltage $V_{th1}$ is compared with the value of the first driving signal $V_{data1}$, and a product of N and the value of the first driving signal $V_{data1}$ is set as the threshold reference voltage $V_{ref}$ of the driving transistor $D_{TFT}$ ($V_{ref}=N\cdot V_{data1}$) in a case where the first threshold voltage $V_{th1}$ of the driving transistor $D_{TFT}$ is equal to the value of the first driving signal $V_{data1}$ (i.e., $V_{th1}=V_{data1}$), wherein N is greater than 0 and less than or equal to 1 (that is, $N\in(0, 1]$). For example, when N is equal to 0.5 (that is, N=0.5), $V_{ref}=0.5V_{data1}$.

In S403, a sum of the threshold reference voltage $V_{ref}$ and the value of the first driving signal $V_{data1}$ is calculated to obtain the value of the second driving signal $V_{data2}$ of the driving transistor $D_{TFT}$, i.e., $V_{data2}=V_{ref}+V_{data1}=N\cdot V_{data1}+V_{data1}=(N+1)V_{data1}$.

It will be understood here that, in a case where the first threshold voltage $V_{th1}$ of the driving transistor $D_{TFT}$ is equal to the value of the first driving signal $V_{data1}$, S402 and S403 may be accomplished in one step. That is, in a case where the first threshold voltage $V_{th1}$ of the driving transistor $D_{TFT}$ is equal to the value of the first driving signal $V_{data1}$, a product of a sum of N and 1 and $V_{data1}$ may be directly set as the value of the second driving signal $V_{data2}$ of the driving transistor $D_{TFT}$. In this way, the process of obtaining the threshold reference voltage $V_{ref}$ may be omitted, therefore simplifying the steps of the method for detecting the threshold voltage of the driving transistor $D_{TFT}$.

In S404, a second threshold voltage $V_{th2}$ of the driving transistor $D_{TFT}$ is obtained, the second threshold voltage $V_{th1}$ being a threshold voltage of the driving transistor $D_{TFT}$ when the driving transistor $D_{TFT}$ is driven by the second driving signal $V_{data2}$.

With regard to how the detection range of the threshold voltage is increased in embodiments of the present disclosure, reference may be made to corresponding description in some foregoing embodiments, and details will not be repeated here.

It will be understood that in the process of detecting the threshold voltages of the plurality of driving transistors in the display apparatus, various detection methods provided in some embodiments above may be appropriately selected and used according to actual needs. Of course, the embodiments above are merely examples, and the protection scope of the present disclosure is not limited thereto. Any person skilled in the art could readily conceive of changes or replacements within the technical scope disclosed by the present disclosure, which shall all be included in the protection scope of the present disclosure. For example, the threshold reference voltage $V_{ref}$ may be determined according to a median value of the first threshold voltages of the plurality of driving transistors, and details will not be repeated herein.

In addition, in some of the foregoing embodiments, no matter which method for detecting the threshold voltage is used, as for the display apparatus itself, a detection method with a pre-set cycle is generally adopted. Moreover, the second driving signal of the present detection may be used as the first driving signal of the next detection. The pre-set cycle includes: pre-setting one detection every day, or pre-setting one detection each time the display apparatus is turned on or turned off.

Some embodiments of the present disclosure provide an apparatus for detecting a threshold voltage of a driving transistor. As shown in FIG. 7, the apparatus 10 for detecting the threshold voltage of the driving transistor includes at least one source voltage obtaining circuit 100, and a processor 200 electrically connected to each source voltage obtaining circuit 100. Each source voltage obtaining circuit 100 is configured to be electrically connected to a driving transistor of at least one driving transistor and detect a source voltage of the driving transistor.

The processor 200 is configured to: obtain at least one first threshold voltage of the at least one driving transistor according to at least one source voltage detected by the at least one source voltage obtaining circuit 100 respectively, each first threshold voltage being a threshold voltage of a corresponding driving transistor obtained when the corresponding driving transistor is driven by a corresponding first driving signal; obtain a threshold reference voltage $V_{ref}$ of the driving transistor $D_{TFT}$ according to the at least one first threshold voltage; obtain a second driving signal $V_{data2}$ of the driving transistor $D_{TFT}$ according to the threshold reference voltage $V_{ref}$ and the first driving signal $V_{data1}$, a value of the second driving signal $V_{data2}$ being greater than a value of the first driving signal $V_{data1}$; and obtain a second threshold voltage $V_{th2}$ of the driving transistor $D_{TFT}$ according to a source voltage detected by a source voltage obtaining circuit 100 when the driving transistor $D_{TFT}$ is driven by the second driving signal $V_{data2}$ and the second driving signal $V_{data2}$, the second threshold voltage $V_{th2}$ being a threshold voltage of the driving transistor $D_{TFT}$ obtained when the driving transistor $D_{TFT}$ is driven by the second driving signal $V_{data2}$.

A structure of the source voltage obtaining circuit 100 may be set according to actual needs, as long as the source voltage obtaining circuit 100 can detect the voltage at the source of the driving transistor. For example, the structure of each source voltage obtaining circuit 100 is as shown in FIG. 1. The source voltage obtaining circuit 100 includes a second transistor T2, a second capacitor Csense, and an analog-to-digital converter ADC. As for a connection relationship among the components, reference may be made to relevant description in the foregoing embodiments, and details will not be repeated here.

In some embodiments of the present disclosure, the apparatus 10 for detecting the threshold voltage of the driving transistor may effectively obtain the threshold voltage of at least one driving transistor $D_{TFT}$. The apparatus 10 for detecting the threshold voltage of the driving transistor may achieve the same technical effects as the method for detecting the threshold voltage of the driving transistor provided in the foregoing embodiments, and details will not be repeated here.

In some embodiments, as shown in FIG. 7, the apparatus 10 for detecting the threshold voltage of the driving transistor $D_{TFT}$ further includes a memory 300 configured to store the at least one first driving signal. In this case, the processor 200 is configured to obtain the at least one first threshold voltage of the at least one driving transistor according to the at least one source voltage detected by the at least one source voltage obtaining circuit 100 respectively and stores the at least one first driving signal in the memory 300.

In some embodiments, the processor 200 implements the detection process described above in the form of software. The memory 300 stores a computer program that can run on the processor 200. The processor 200 is configured to execute the computer program, so as to realize the method of obtaining the first threshold voltage $V_{th1}$ of the driving transistor $D_{TFT}$ according to its voltage $V_S$ at the source and the first driving signal $V_{data1}$, obtaining its threshold reference voltage $V_{ref}$ according to its first threshold voltage $V_{th1}$, and obtaining its second driving signal $V_{data2}$ according to the threshold reference voltage $V_{ref}$ and the first driving signal $V_{data1}$.

It is to be noted that the second driving signal $V_{data2}$ of the driving transistor $D_{TFT}$ may be sent to the driving transistor $D_{TFT}$ as a driving signal as soon as it is obtained by the processor 200. Or the second driving signal $V_{data2}$ may be stored in the memory 300 before being sent to the driving transistor $D_{TFT}$ as a driving signal.

Exemplary, the memory 300 includes a high-speed random access memory or a non-volatile memory. For example, the memory is a magnetic disk storage device, a flash memory device, or other volatile solid-state storage devices. Exemplary, the processor includes at least one of a central processor (CPU), a general purpose processor, a digital signal processor (DSP), an application-specific integrated circuit (ASIC), a field programmable gate array (FPGA), a programmable logic device, a transistor logic device, or a hardware component, so as to implement or execute various exemplary logical blocks, modules, and circuits described in some embodiments of the present disclosure. In addition, the processor, as a combination that realizes a computing function, includes, for example, a combination of one or more microprocessors, or a combination of a digital signal processor (DSP) and a microprocessor, etc.

In some other embodiments, the processor 200 implements the detection process described above in the form of hardware. For example, the processor 200 includes at least one threshold reference voltage obtaining circuit and at least one driving signal update circuit. The at least one threshold reference voltage obtaining circuit is configured to obtain the threshold reference voltage $V_{ref}$ of the driving transistor $D_{TFT}$ according to at least one first threshold voltage of the at least one driving transistor. Each of the at least one threshold reference voltage obtaining circuit includes at least one of an adder, a divider, a multiplier, or a comparator, etc., which can be selected and set according to actual needs of the detection method.

The at least one driving signal update circuit is configured to obtain the second driving signal $V_{data2}$ of the driving transistor $D_{TFT}$ according to the threshold reference voltage $V_{ref}$ and the first driving signal $V_{data1}$ of the driving circuit $D_{TFT}$. Each driving signal update circuit includes at least one of an adder, or a multiplier, etc., which can be selected and set according to actual needs of the detection method.

Figure 8:
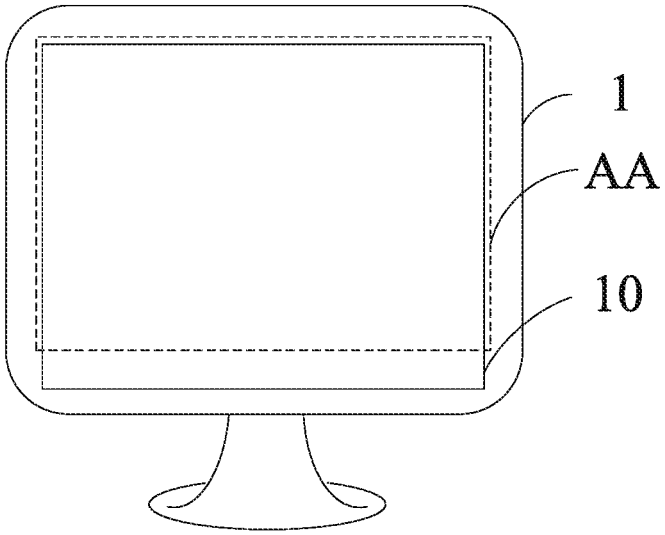
FIG. 8 is a schematic diagram of a display apparatus, according to some embodiments of the present disclosure.

Some embodiments of the present disclosure provide a display apparatus. As shown in FIG. 8, the display apparatus 1 includes the apparatus 10 for detecting the threshold voltage of the driving transistor provided in some of the foregoing embodiments, and has the same beneficial effects as the apparatus for detecting the threshold voltage of the driving transistor provided in some of the foregoing embodiments. Since the structure and the beneficial effects of the apparatus for detecting the threshold voltage of the driving transistor have been described in detail in the foregoing embodiments, details will not be repeated here.

In some examples, the display apparatus includes an OLED display panel. The OLED display panel is applied to a product or a component having a display function such as a display, a television, a digital photo frame, a mobile phone, or a tablet computer.

The method for detecting the threshold voltage of the driving transistor described in some embodiments of the present disclosure may be implemented by means of executing instructions. The instructions may be executed by one or more processors, and the instructions can be stored in a random access memory (RAM), a flash memory, a read only memory (ROM), an erasable programmable read only memory (EPROM), an electrically erasable programmable read only memory (EEPROM), a register, a hard disk, a removable hard disk, a compact disk read only memory (CD-ROM), or any other form of storage medium known in the art.

On this basis, some embodiments of the present disclosure provide a computer product. The computer product includes one or more processors. The one or more processors are configured to execute computer instructions to perform one or more steps in the method for detecting the threshold voltage of the driving transistor as described in some of the above embodiments.

Some embodiments of the present disclosure provide a non-transitory computer-readable storage medium. The non-transitory computer-readable storage medium stores computer instructions that, when executed by a display apparatus, cause the display apparatus to perform the method for detecting the threshold voltage of the driving transistor as described in some of the above embodiments.

Some embodiments of the present disclosure provide a computer program. After the computer program is loaded into a processor, the computer program causes the processor to perform the method for detecting the threshold voltage of the driving transistor as described in some of the above embodiments.

A person skilled in the art will appreciate that in one or more of the examples described above, the described functions may be implemented by using a hardware, a software, a firmware, or any combination thereof. When implemented in software, the functions may be stored on a computer-readable medium or transmitted as one or more instructions or codes on a computer-readable medium. The computer-readable medium includes a computer storage medium and a communication medium, and the communication medium includes any medium convenient for transmitting computer programs from one location to another. The storage medium may be any available medium that can be accessed by a general-purpose or special-purpose computer.

In the description of the foregoing embodiments, specific features, structures, materials, or characteristics may be combined in a suitable manner in any one or more embodiments or examples.

The foregoing descriptions are merely some specific implementation manners of the present disclosure, but the protection scope of the present disclosure is not limited thereto. Any person skilled in the art could readily conceive of changes of replacements within the technical scope disclosed by the present disclosure, which shall all be included in the protection scope of the present disclosure. Therefore, the protection scope of the present disclosure shall be subject to the protection scope of the claims.

What is claimed is:

1. A method for detecting a threshold voltage of a driving transistor, the method comprising:

obtaining at least one first threshold voltage of at least one driving transistor, each first threshold voltage being a threshold voltage of a corresponding driving transistor obtained when the corresponding driving transistor is driven by a corresponding first driving signal;

obtaining a threshold reference voltage of the driving transistor according to the at least one first threshold voltage;

obtaining a second driving signal of the driving transistor according to the threshold reference voltage and a first driving signal of the driving transistor, a value of the second driving signal being greater than a value of the first driving signal; and obtaining a second threshold voltage of the driving transistor, the second threshold voltage being a threshold voltage of the driving transistor obtained when the driving transistor is driven by the second driving signal;

wherein obtaining the at least one first threshold voltage of the at least one driving transistor, includes:

obtaining first threshold voltages of the plurality of driving transistors in the display apparatus;

wherein obtaining the threshold reference voltage of the driving transistor according to the at least one first threshold voltage, includes:

comparing a characteristic value of the plurality of first threshold voltages with the value of the first driving signal or half of the value of the first driving signal; and determining the threshold reference voltage of the driving transistor according to a comparison result.

2. The method according to claim 1, wherein comparing the characteristic value of the plurality of first threshold voltages with the value of the first driving signal or half of the value of the first driving signal, includes:

comparing an average value of the plurality of first threshold voltages with the half of the value of the first driving signal; and determining the threshold reference voltage of the driving transistor according to a comparison result:

setting the average value as the threshold reference voltage of the driving transistor in response to a determination of the average value being greater than the half of the value of the first driving signal.

3. The method according to claim 2, wherein obtaining the second driving signal of the driving transistor according to the threshold reference voltage and the first driving signal, includes:

calculating a sum of the threshold reference voltage and a product of P and the value of the first driving signal to obtain the value of the second driving signal of the driving transistor, wherein P is greater than or equal to 0.5, and less than or equal to 1.

4. The method according to claim 3, wherein P is equal to 0.5.

5. The method according to claim 1, wherein comparing the characteristic value of the plurality of first threshold voltages with the value of the first driving signal or half of the value of the first driving signal, includes:

comparing a minimum value of the plurality of first threshold voltages with the half of the value of the first driving signal; and determining the threshold reference voltage of the driving transistor according to a comparison result:

setting the minimum value as the threshold reference voltage of the driving transistor in response to a determination of the minimum value being greater than the half of the value of the first driving signal.

6. The method according to claim 5, wherein obtaining the second driving signal of the driving transistor according to the threshold reference voltage and the first driving signal, includes:

calculating a sum of the threshold reference voltage and the value of the first driving signal to obtain the value of the second driving signal of the driving transistor.

7. The method according to claim 1, wherein comparing the characteristic value of the plurality of first threshold voltages with the value of the first driving signal or half of the value of the first driving signal, includes:

comparing a maximum value of the plurality of first threshold voltages with the value of the first driving signal; and determining the threshold reference voltage of the driving transistor according to a comparison result:

setting the maximum value as the threshold reference voltage of the driving transistor in response to a determination of the maximum value being equal to the value of the first driving signal.

8. The method according to claim 7, wherein obtaining the second driving signal of the driving transistor according to the threshold reference voltage and the first driving signal, includes:

calculating a sum of the threshold reference voltage and a product of M and the value of the first driving signal to obtain the value of the second driving signal of the driving transistor, wherein M is greater than 0 and less than or equal to 0.5.

9. The method according to claim 8, wherein M is equal to 0.5.

10. A non-transitory computer-readable storage medium storing computer instructions that, when being executed by a display apparatus, cause the display apparatus to perform the method for detecting the threshold voltage of the driving transistor according to claim 1.

11. The method according to claim 1, wherein the value of the second driving signal is further greater than a value of the threshold reference voltage.

12. The method according to claim 1, wherein the second threshold voltage is used as the threshold voltage of the driving transistor.

13. An apparatus for detecting a threshold voltage of a driving transistor, the apparatus comprising:

at least one source voltage obtaining circuit, wherein each source voltage obtaining circuit is configured to be electrically connected to a driving transistor of at least one driving transistor, and detect a source voltage of a corresponding driving transistor;

a processor electrically connected to each source voltage obtaining circuit, wherein the processor is configured to:

obtain at least one first threshold voltage of the at least one driving transistor according to at least one source voltage detected by the at least one source voltage obtaining circuit respectively, each first threshold voltage being a threshold voltage of a corresponding driving transistor obtained when the corresponding driving transistor is driven by a corresponding first driving signal;

obtain a threshold reference voltage of the driving transistor according to the at least one first threshold voltage;

obtain a second driving signal of the driving transistor according to the threshold reference voltage and a first driving signal of the driving transistor, a value of the second driving signal being greater than a value of the first driving signal corresponding to a same driving transistor; and obtain a second threshold voltage of the driving transistor according to a source voltage detected by a source voltage obtaining circuit and the second driving signal, the second threshold voltage being a threshold voltage of the driving transistor obtained when the driving transistor is driven by the second driving signal, wherein the processor is further configured to:

obtain first threshold voltages of the plurality of driving transistors in the display apparatus;

compare a characteristic value of the plurality of first threshold voltages with the value of the first driving signal or half of the value of the first driving signal; and determine the threshold reference voltage of the driving transistor according to a comparison result.

14. The apparatus according to claim 13, further comprising a memory configured to store at least one first driving signal, wherein the processor is configured to:

obtain the at least one first threshold voltage of the at least one driving transistor according to the at least one source voltage detected by the at least one source voltage obtaining circuit respectively and at least one first driving signal stored in the memory.

15. A display apparatus, comprising the apparatus for detecting the threshold voltage according to claim 13.

16. A method for detecting a threshold voltage of a driving transistor, the method comprising:

obtaining at least one first threshold voltage of at least one driving transistor, each first threshold voltage being a threshold voltage of a corresponding driving transistor obtained when the corresponding driving transistor is driven by a corresponding first driving signal;

obtaining a threshold reference voltage of the driving transistor according to the at least one first threshold voltage;

obtaining a second driving signal of the driving transistor according to the threshold reference voltage and a first driving signal of the driving transistor, a value of the second driving signal being greater than a value of the first driving signal; and obtaining a second threshold voltage of the driving transistor, the second threshold voltage being a threshold voltage of the driving transistor obtained when the driving transistor is driven by the second driving signal;

wherein obtaining at least one first threshold voltage of at least one driving transistor includes:

obtaining a first threshold voltage of the driving transistor;

wherein obtaining the threshold reference voltage of the driving transistor according to the at least one first threshold voltage, includes:

comparing the first threshold voltage with the value of the first driving signal; and determining the threshold reference voltage of the driving transistor according to a comparison result: setting a product of N and the value of the first driving signal as the threshold reference voltage of the driving transistor in response to a determination of the first threshold voltage being equal to the value of the first driving signal, wherein N is greater than 0 and less than or equal to 1.

17. The method according to claim 16, wherein obtaining the second driving signal of the driving transistor according to the threshold reference voltage and the first driving signal, includes:

calculating a sum of the threshold reference voltage and the value of the first driving signal to obtain the value of the second driving signal of the driving transistor.

18. The method according to claim 16, wherein the value of the second driving signal is further greater than a value of the threshold reference voltage.

19. The method according to claim 16, wherein the second threshold voltage is used as the threshold voltage of the driving transistor.

20. An apparatus for detecting a threshold voltage of a driving transistor, the apparatus configured to perform the method according to claim 16, the apparatus comprising:

at least one source voltage obtaining circuit, wherein each source voltage obtaining circuit is configured to be electrically connected to a driving transistor of at least one driving transistor, and detect a source voltage of a corresponding driving transistor;

a processor electrically connected to each source voltage obtaining circuit, wherein the processor is configured to:

obtain at least one first threshold voltage of the at least one driving transistor according to at least one source voltage detected by the at least one source voltage obtaining circuit respectively, each first threshold voltage being a threshold voltage of a corresponding driving transistor obtained when the corresponding driving transistor is driven by a corresponding first driving signal;

obtain a threshold reference voltage of the driving transistor according to the at least one first threshold voltage;

obtain a second driving signal of the driving transistor according to the threshold reference voltage and a first driving signal of the driving transistor, a value of the second driving signal being greater than a value of the first driving signal corresponding to a same driving transistor; and obtain a second threshold voltage of the driving transistor according to a source voltage detected by a source voltage obtaining circuit and the second driving signal, the second threshold voltage being a threshold voltage of the driving transistor obtained when the driving transistor is driven by the second driving signal, wherein the processor is further configured to:

obtain a first threshold voltage of the driving transistor;

compare the first threshold voltage with the value of the first driving signal; and determine the threshold reference voltage of the driving transistor according to a comparison result: set a product of N and the value of the first driving signal as the threshold reference voltage of the driving transistor in response to a determination of the first threshold voltage being equal to the value of the first driving signal, wherein N is greater than 0 and less than or equal to 1.

* * * * *